US005810648A

United States Patent [19]

Jiang et al.

[11] Patent Number: 5,810,648

[45] Date of Patent: Sep. 22, 1998

[54] DEVICE FOR TEXTURING A DISC SUBSTRATE

[75] Inventors: Zhaoguo Jiang, Fremont; Ming M. Yang, San Jose; James L. Chao, Milpitas; Bruce M. Harper, San Jose; Michael A. Russak, Los Gatos, all of Calif.

[73] Assignee: HMT Technology Corporation, Fremont, Calif.

[21] Appl. No.: 811,970

[22] Filed: Mar. 5, 1997

[51] Int. Cl.[6] ..... B24B 5/08

[52] U.S. Cl. ..... 451/285; 451/41; 451/63; 451/65; 451/287; 451/550

[58] Field of Search ..... 451/285–290, 451/63, 292, 291, 550, 41, 42, 65, 461

[56] References Cited

U.S. PATENT DOCUMENTS

| | | | |
|---|---|---|---|
| 3,611,642 | 10/1971 | Stoy | 451/65 |
| 4,430,782 | 2/1984 | Bornhorst et al. | 451/290 |
| 5,187,901 | 2/1993 | Karlsrud | 451/290 |
| 5,197,230 | 3/1993 | Simpfendorfer et al. | 451/291 |
| 5,389,032 | 2/1995 | Beardsley | 451/461 |

FOREIGN PATENT DOCUMENTS

| | | |
|---|---|---|
| 2249134 | 10/1990 | Japan . |
| 5282664 | 10/1993 | Japan . |
| 6176358 | 6/1994 | Japan . |
| 7057253 | 3/1995 | Japan . |
| 7296539 | 11/1995 | Japan . |
| 7320259 | 12/1995 | Japan . |

*Primary Examiner*—Robert A. Rose
*Assistant Examiner*—George Nguyen
*Attorney, Agent, or Firm*—Judy M. Mohr; Jeffery D. Frazier; Peter J. Dehlinger

[57] ABSTRACT

A texturing device for texturing a disc substrate of the type used in forming a thin-film medium is described. The device includes a rotatable assembly having a first pad attached to one end of a spindle and an annular ring having a second pad attached on one surface. Each pad defines a texturing surface for texturing the inner and outer regions of the disc substrate.

20 Claims, 6 Drawing Sheets

DEVICE FOR TEXTURING A DISC SUBSTRATE

FIELD OF THE INVENTION

The present invention relates to a device for texturing a disc substrate of the type used in thin-film media, particularly thin-film magnetic recording media.

BACKGROUND OF THE INVENTION

Many high capacity disc drives in computer systems use thin-film magnetic media for storage of binary encoded data. In a typical disc drive, a magnetic disc is rotated at a high speed and data is written and read by a magnetic head flying above the rotating disc. Typically, the magnetic read/write head rides on a thin cushion of air as it moves along data tracks on the surface of the spinning disc.

In a typical disc drive, the magnetic head rests on an inner, annular landing zone of the disc surface when the drive is not in use. When the drive is turned on for reading or writing data, the disc starts spinning and the head slides along its surface until it lifts away due to air trapped between the disc and the head. When the head reaches its fly height, it is moved radially over a data area on the disc where data is written and read without physical contact by the head. The reverse process occurs when the disc is brought to a stop, where the head is aligned with the landing zone, contact is made with the disc and the head comes to rest.

The topography of the disc surface has important effects on performance of the drive as a whole and on the magnetic recording properties of the disc itself. Texturing or polishing the disc surface with a generally circumferential pattern in the data zone is known to improve the magnetic performance and to increase the potential data density by improving the squareness and orientation ratio of the magnetic layer.

Providing texture in the landing zone has tribological benefits as well, including reducing wear, enhancing lubrication and reducing stiction. Grooves created by abrasion of the disc surface act as reservoirs for a topical lubricant, replenishing the lubricant as it is worn away by contact with the magnetic head. Texturing overcomes stiction by preventing the head from coming into contact with a continuous flat surface when the head is at rest on the disc surface.

It is most often the case that a uniform texture is applied to both the landing zone and the data zone of the disc. However, a single texture does not provide optimum results in both zones. In the data zone, a fine texture to allow for a small head fly height is desired, to enhance magnetic performance. In the landing zone, a rougher texture is desired, to reduce stiction.

SUMMARY OF THE INVENTION

Accordingly, it is an object of the invention to provide a device for texturing a disc substrate and to provide a device for simultaneous differential texturing on the disc.

In one aspect, the invention includes a texturing device for texturing a disc substrate of the type used in forming a thin-film medium. The device includes a rotatable assembly having (i) a spindle adapted for rotation about a spindle axis, and (ii) a first pad attached to one end of the spindle for rotation therewith. The first pad defines an inner texturing surface substantially normal to the spindle axis. The device also includes an annular ring having a second pad attached on one surface. The ring is mounted on the rotatable assembly for movement thereon toward and away from the first pad, substantially in the direction of the spindle axis. The second pad defines an outer annular texturing surface which encompasses the inner texturing surface, when the ring is fully moved toward the first pad. The outer texturing surface presses against a disc substrate surface with a force that depends on the weight of the ring, when the rotatable assembly is positioned with its inner texturing surface placed against the disc substrate surface.

In one embodiment, the annular ring, when fully moved toward the first pad, mounts on the rotatable assembly for rotation thereon, independent of rotation of the first pad. The device, in this embodiment, further includes a brake in contact with the ring to control rotation of the ring.

In another embodiment, the annular ring, when fully moved toward the first pad, mounts on the rotatable assembly for rotation therewith. In this embodiment, the ring includes a central opening and the spindle engages the central opening. The first pad engages a confronting surface of the ring, securing the ring to the first pad.

According to another embodiment of the invention, a texturing slurry is introduced between the two texturing surfaces through a gap defined by the spindle and an inner edge of the ring and an inner edge of the first pad. The slurry contains abrasive particles having sizes between 0.05–20 microns.

In another embodiment, the device further includes means for biasing the inner texturing surface against the disc substrate, with a load of between 1–30 pounds. The annular ring has a weight of between about 1–30 pounds, in another embodiment.

In another embodiment, the outer annular texturing surface has an area of between 10–100 $cm^2$ and the first and second pads are coaxial. The pads are made of identical materials or of different materials.

The spindle in the device rotates with a speed of between 1–2000 RPM. The ring rotates at a speed of between 1–2000 RPM.

These and other objects and features of the invention will be more fully appreciated when the following detailed description of the invention is read in conjunction with the accompanying drawings.

DETAILED DESCRIPTION OF THE INVENTION

Figure 1A:
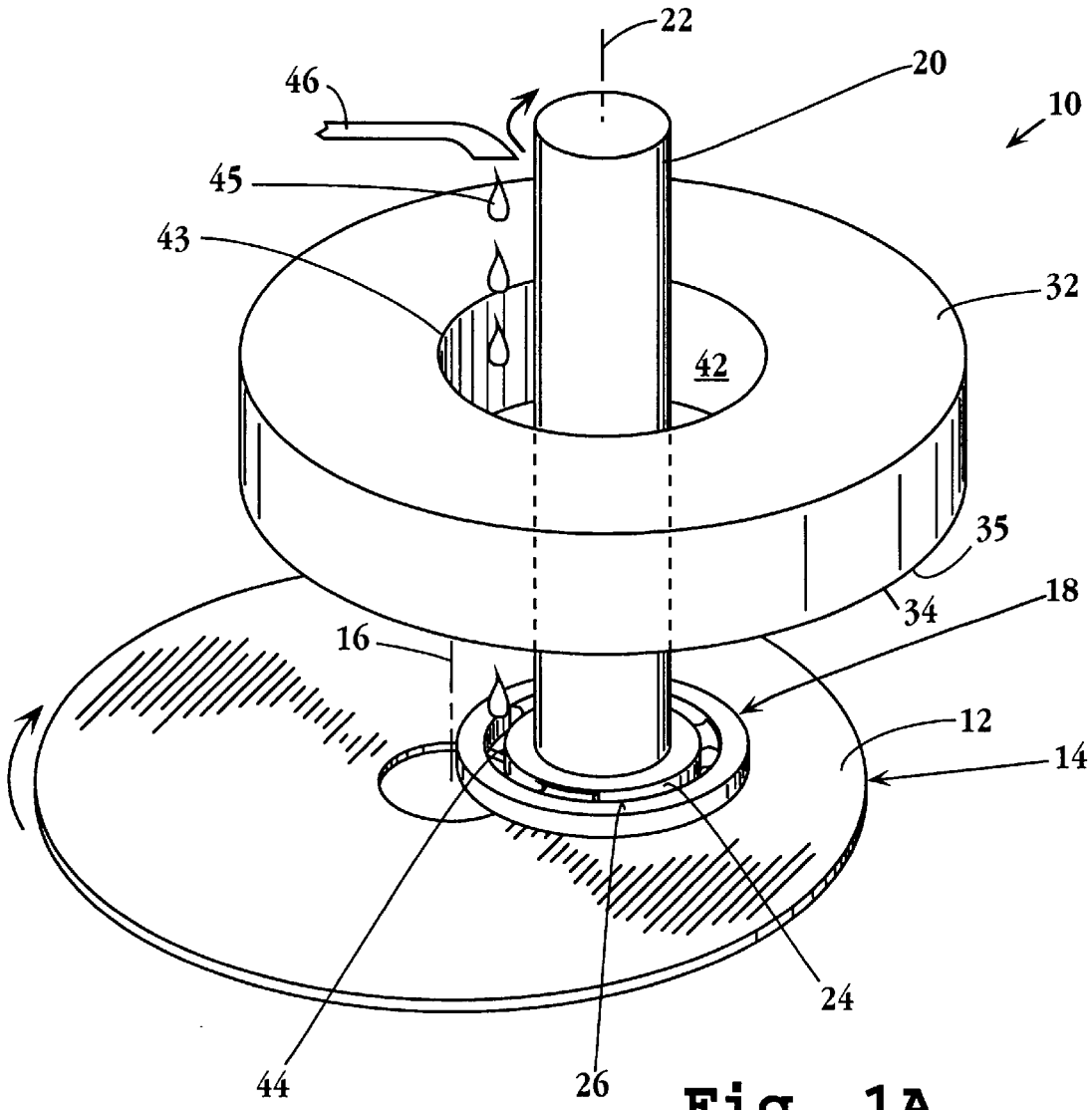
FIGS. 1A–1B show one embodiment of the texturing device of the present invention, in perspective view (FIG. 1A) and in cross section (FIG. 1B)

FIG. 1A is a schematic view of an apparatus 10 for texturing a surface 12 of a disc substrate 14, of the type used in forming thin-film magnetic recording media, for example, a rigid aluminum substrate plated with nickel/phosphorus. Substrate 14 is carried on a substrate assembly, not shown in the figure, for rotation about a central axis, indicated by a dashed line 16. Such an assembly includes a spindle which is driven by an adjustable motor to vary the speed of disc rotation.

Texturing device 10 includes a rotatable assembly 18 having a spindle 20 which is rotatable about a spindle axis, indicated by the dashed line 22, that is offset from central axis 16. The spindle is driven at a selected speed by a motor (not shown) in the rotatable assembly. Rotatable assembly 18 includes a first texturing pad 24 attached to one end of spindle 20 for rotation therewith. As will be described, first pad 24 defines a texturing surface and, when positioned for a disc texturing operation, contacts the surface of the substrate for texturing.

The rotatable assembly is mounted in the device for shifting toward and away from the disc substrate, that is, in a direction parallel with the axes 16, 22. As seen best in FIG. 1B, pad 24 when moved toward the disc substrate to a texturing position, contacts surface 12 of disc substrate 14, defining an inner texturing surface 27, which is substantially normal to spindle axis 22. The inner texturing surface approximately corresponds to a disc landing zone 28, discussed above and indicated in FIG. 2 by dashed line 30, which represents the boundary between the inner disc landing zone and an outer disc data zone 36.

In one embodiment, the texturing device further includes a means for applying a load to the first pad. For example, a load applied to spindle 20 by mounting a weight to the spindle or by device for applying a selected load in contact with the spindle, such as an air-pressure device, are suitable. Such means for applying a selected load to the spindle are referred to herein as biasing means.

With reference again to FIG. 1A, texturing device 10 also includes an annular ring 32 having a second texturing pad 34 attached on one surface. Second pad 34 defines an outer annular texturing surface 35 which, as seen best in FIG. 2, encompasses the inner texturing surface, for texturing the entire disc surface, e.g., the disc landing zone 28 and data zone 36.

Figure 1B:
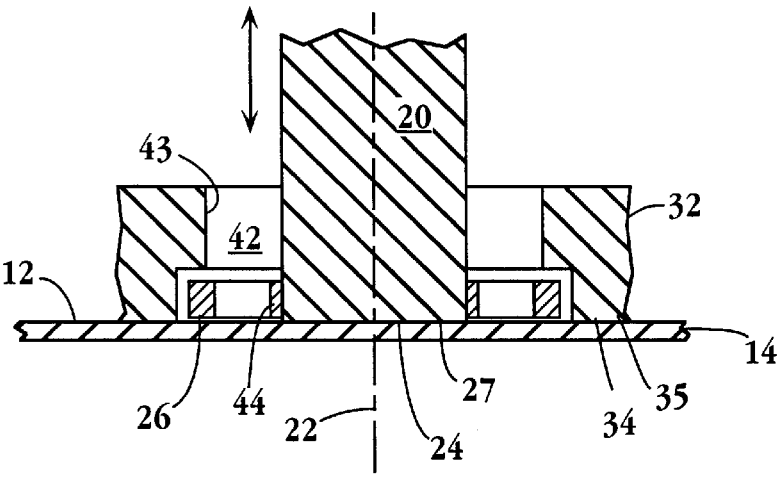
Figure 2:
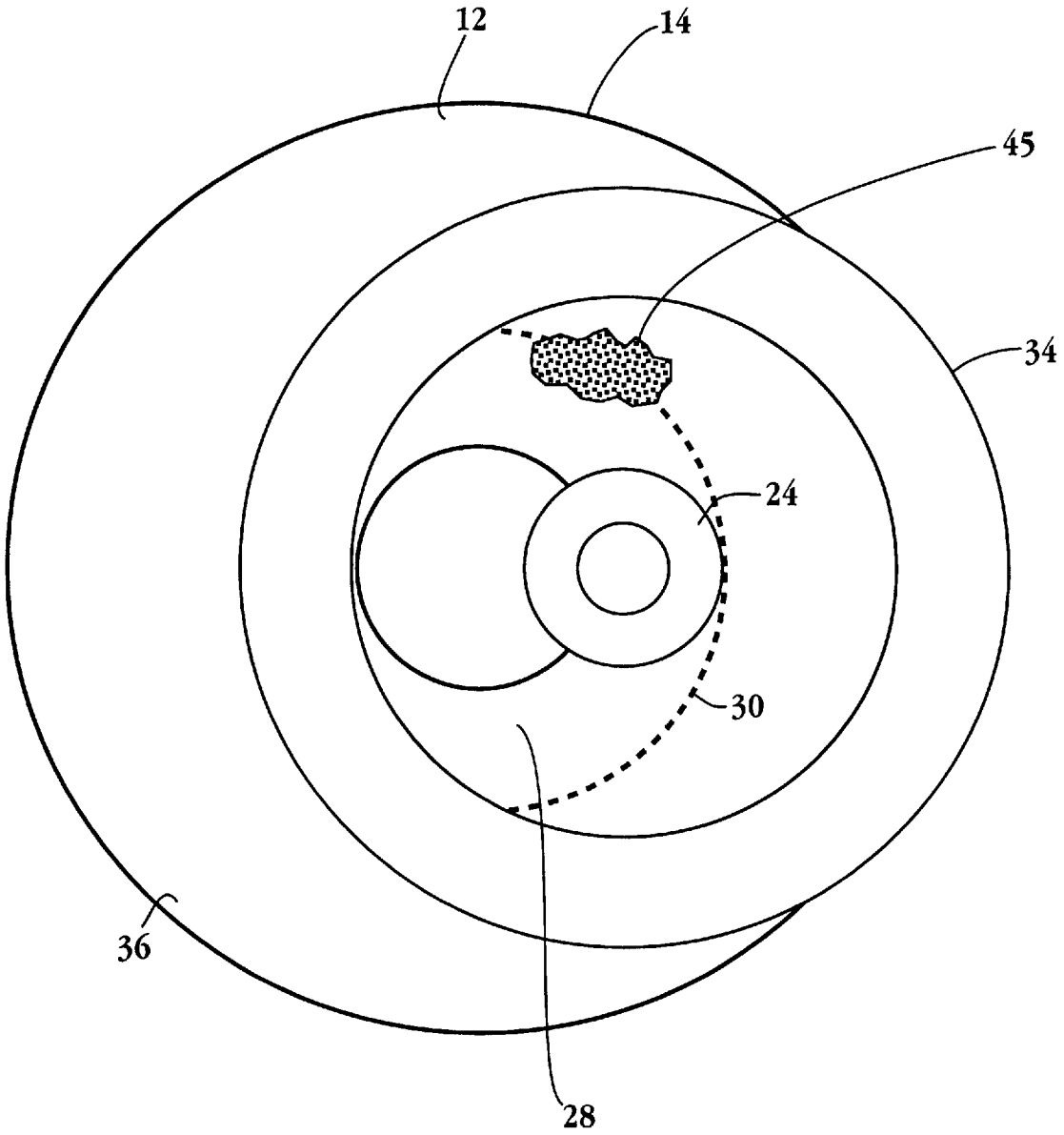
FIG. 2 is a plan view of a disc substrate for texturing, showing the relative positions of the first and second pads of the device in accordance with one embodiment of the invention.

Annular ring 32 is mounted on rotatable assembly 18 for movement thereon toward and away from the first pad, substantially in the direction of the spindle axis 22, as seen most clearly in FIG. 1B. Annular ring 32 in a preferred embodiment is a dead-weight of between about 1–30 pounds. When the annular ring is moved toward the disc substrate, that is, toward the first pad, the ring mounts on the rotatable assembly, as can be appreciated by viewing FIG. 1B, and is spaced from first pad 24 by an outer ring member 26 in the rotatable assembly.

In the embodiment shown in FIG. 1, the annular ring, when fully moved toward the first pad, rotates independent of rotation of the first pad. As can be appreciated upon viewing FIGS. 1A–1B, when annular ring 32 is fully moved toward the first pad and is mounted on the rotatable assembly, the second pad contacts the surface of the rotating substrate, for rotation with the substrate and texturing of the substrate surface, as will be described.

Figure 3:
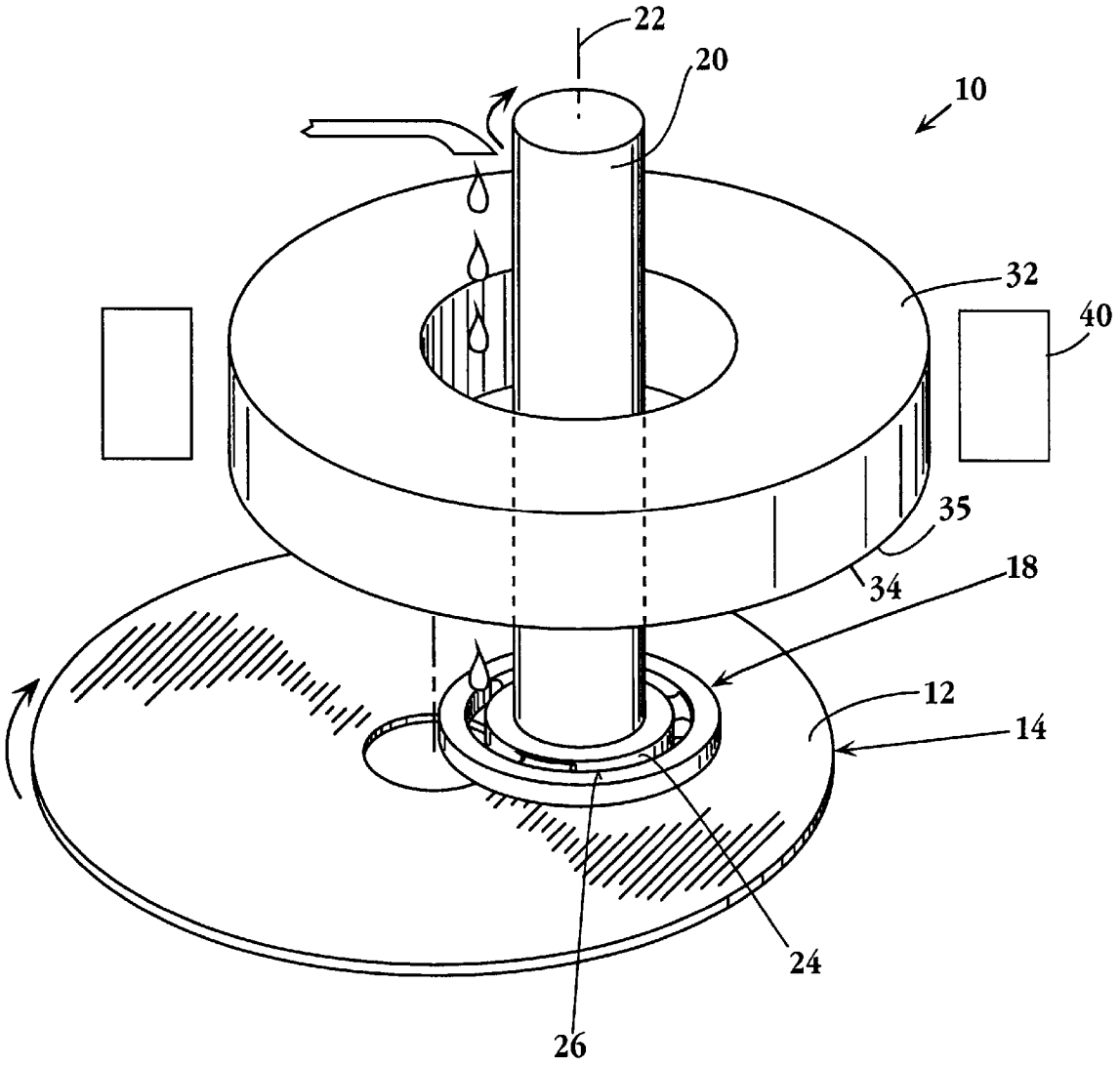
FIG. 3 shows the device of FIG. 1 additionally including a brake system for controlling the rotational speed of the second pad.

FIG. 3 shows an embodiment of texturing device 10 where rotation of annular ring 32, and of the second pad attached thereto, is controlled by a brake 40. The brake, operated by an assembly not shown in the figure, presses against annular ring 32 to control rotation of the ring by generating a constant friction on the annular ring. It will also be appreciated that the brake can slow rotation of the ring, and therefore of the second pad, or can intermittently hold and release the annular ring to achieve intermittent rotation of the second pad for intermittent texturing.

The rotation speed of the texturing pads, along with other operational parameters of the texturing device to be discussed, define the texturing pattern achieved.

The texturing device of the present invention provides a means to bring both the inner, first pad and the outer, second pad into contact simultaneously with a substrate for texturing, as can be appreciated by the cross-sectional illustration of the device in FIG. 1B. The two pads are brought into contact with the surface of the substrate by moving the annular ring toward the rotatable assembly until the annular ring mounts on the assembly, as illustrated in FIG. 1B. The annular ring and the rotatable assembly are then brought into contact with the substrate surface by movement of the spindle. The reverse procedure is followed to simultaneously move the pads away from the disc substrate surface.

With reference again to FIG. 1A, a gap 42 is defined by spindle 20 and an inner edge 43 of ring 32 and an inner edge 44 of first pad 24. Gap 42 is for introducing a texturing slurry 45, by a tube 46 or other suitable means, between the inner and outer texturing surfaces. As seen best in FIG. 2, the application of texturing slurry 45 to the disc surface between the two texturing surfaces allows for improved distribution of the slurry between the two pads.

The slurry is typically a particle slurry with abrasive particles having a size of between 0.05–20 microns in diameter. Exemplary abrasive particles include diamond fragments and aluminum oxide particles. An exemplary texturing slurry is one containing diamond particles in a glycol slurry supplied by Coral Chemicals (Paramount, Calif.).

The first and second texturing pads are, in one embodiment, composed of the same material. In another embodiment, the pads are composed of different materials. The selection of a material for each pad is determined according to the desired surface texture. For example, stiff, relatively incompressible pad materials achieve a higher surface roughness than softer, more compressible materials. Incompressible materials are effective to produce relatively deep grooves in the substrate surface, whereas softer materials produce a very shallow-groove in the substrate surface, when the pads are brought into contact with the substrate in the presence of a particle slurry.

Relatively incompressible materials suitable for pads include polyurethane impregnated with polyester-based material. An exemplary pad formed of an incompressible material is a Suba-4™ texturing pad, from Rodel (Scottsdale, Ariz). Softer, more compressible materials suitable for pads include polyester-based materials, such as the Ultrapol™ texturing pad, also available from Rodel.

As discussed above, in a preferred embodiment, the texturing device of the present invention is used to texture a substrate for use in a thin-film magnetic recording medium. These substrates are typically a rigid, disc and two conventional size substrates have outer diameters of 130 and 95 mm (5.1 and 3.74 inches), with corresponding inner diameters of 40 and 25 mm (1.57 and 0.98 inches), respectively. The substrate surface is textured using the device of the present invention, where the first, inner pad typically has an outer diameter of about 0.2–2 inches and the outer pad typically has an outer diameter of about 1.5–5.0 inches.

The texturing device, when the first and second pads are positioned for a texturing operation, simultaneously textures the inner and outer regions of the disc substrate, e.g., the landing zone and the data zone, with different texture patterns. More specifically, the first or inner texture pad textures only the inner landing zone. The second outer pad textures the landing zone and the data zone, since the second pad encompasses the region textured by the inner pad. Important features of the device which permit the simultaneous differential texturing of the disc surface include the use of two texturing pads which can be composed of the same or different materials, the ability to vary the load applied to each pad, introduction of a slurry between the pads and the ability to independently vary the speed and direction of rotation of each pad.

Figure 4A:
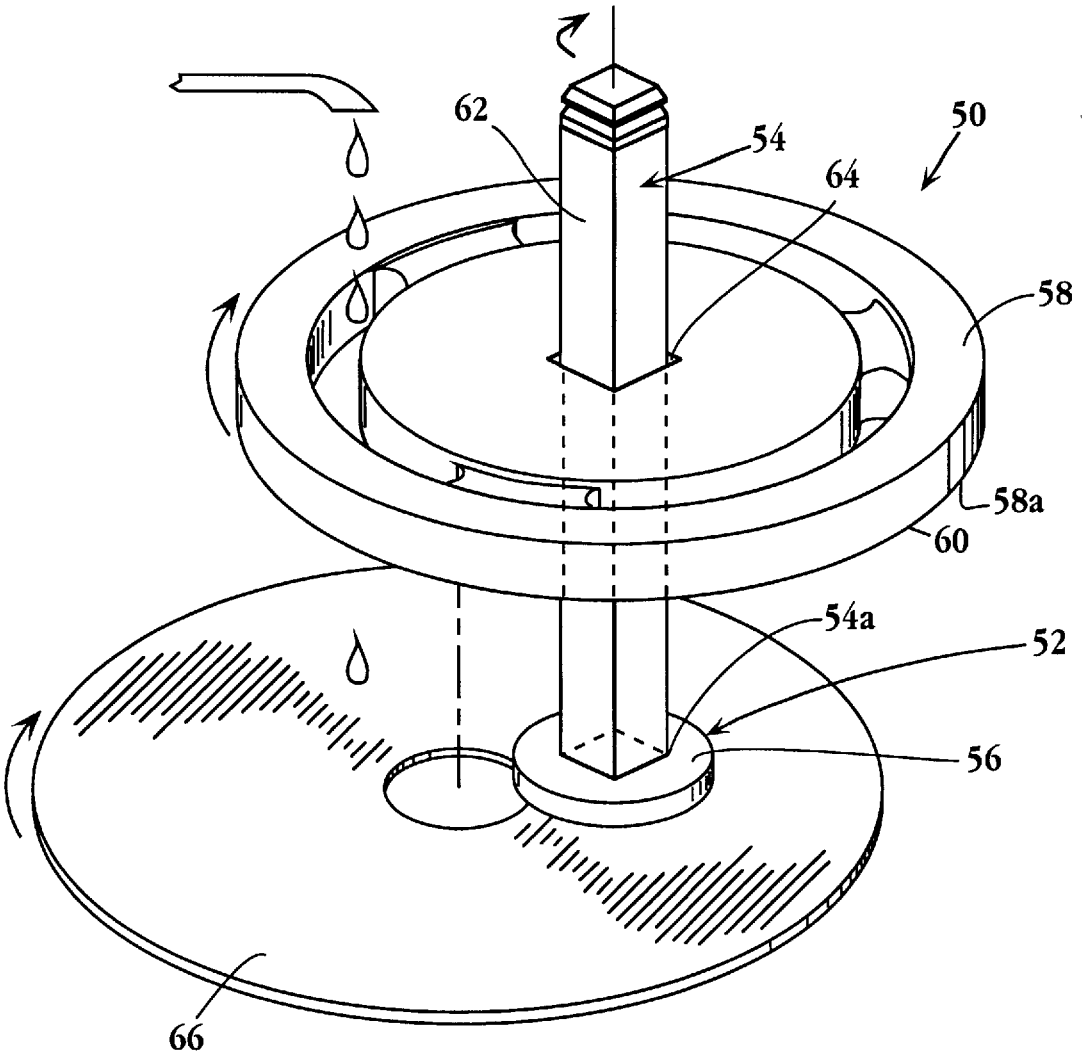
FIGS. 4A–4B show another embodiment of the texturing device of the present invention, in perspective view (FIG. 4A) and in cross section (FIG. 4B)
Figure 4B:
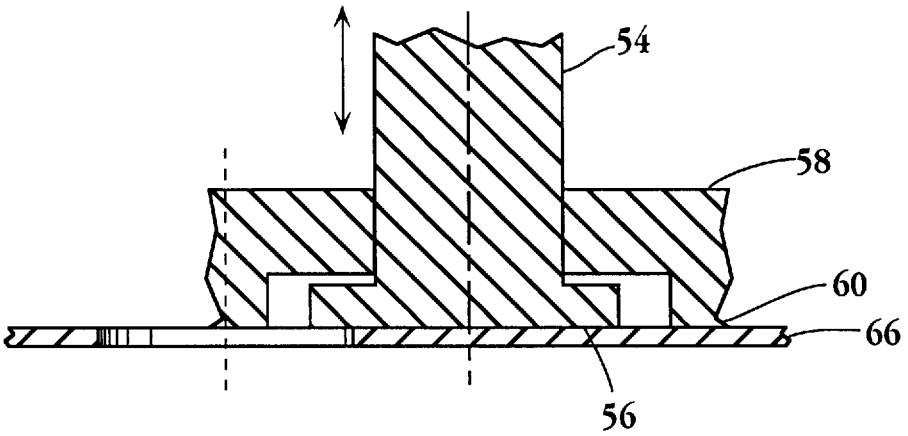

FIGS. 4A–4B show an embodiment of the texturing device where texturing pads in the device rotate at the same speed. Texturing device 50 includes a rotatable assembly 52 composed of a spindle 54 and a first pad 56 attached to one end 54*a* of the spindle. The assembly includes an annular ring 58 having a second pad 60 attached on one surface 58*a* of the annular ring.

Spindle 54 takes the configuration of a elongate, rectangular bar having flat sides, such as side 62. Annular ring 58 has a central opening 64 through which spindle 54 inserts. Spindle 54 engages central opening 64 so that annular ring 58, when moved fully toward first pad 56, mounts on the rotatable assembly for rotation therewith. Spindle 54 is rotated by a drive means, not shown in the figure, for rotation about a spindle axis. The first pad, mounted on one end of the spindle, rotates with the spindle. The second pad, mounted on the annular ring, also rotates with the spindle, since the ring is engaged at its central opening with the spindle. A rotating substrate 66 is contacted by the texturing pads for texturing of the substrate surface. The substrate and the pads can rotate in the same directions or in opposite directions.

In the embodiments of the texturing device shown in the above-discussed figures, the first and second pads are coaxial and rotate together. In another embodiment, the first and second pads are arranged in a non-coaxial fashion for texturing the substrate surface. In this embodiment, the first pad, attached to one end of the spindle as described above, rotates about the spindle axis for texturing an inner region of the disc surface. The second pad is attached to one end of a second spindle and drive assembly for rotation about the second spindle axis and for texturing the disc surface. Alignment of the first and second pads with the disc surface is variable according to the desired surface texture.

I. Substrate Texturing

To produce a textured substrate using the texturing device of the present invention, a substrate is mounted on a spindle. The substrate is preferably a polished aluminum substrate having a nickel/phosphorus plating to achieve a requisite surface hardness.

The operating parameters of the texturing device are selected in accordance with the desired texture pattern, usually defined by the final product requirements, as discussed, for example, in U.S. Pat. No. 5,508,077.

The general operating procedure for a texturing operation using the device of the present invention includes selecting the texturing pads and attaching the pads to the spindle and to the annular ring. The disc substrate to be textured is rotated by rotation of the substrate spindle at a speed of typically between 1–2000 RPM. The load applied to each pad is selected, based on the desired surface roughness and material removal rate requirements. The annular ring is moved toward the rotatable assembly and the two pads are brought into contact with the surface of the rotating substrate. The rotation of the two pads is maintained at the desired speed, typically between 0–2000 rpm, preferably between 0–500 rpm. The texturing slurry is introduced between the pads and the substrate surface and texturing is performed for the desired time, typically 5–120 seconds.

II. Surface Properties of A Textured Disc Substrate

In experiments performed in support of the present invention, a nickel\phosphorus plated aluminum substrate was textured using the texturing device described herein. Texturing was performed using a first pad composed of polyurethane impregnated with polyester-based material and a second pad composed of polyester and polyamide fibers. The second pad had a load of 6 pounds applied by means of an annular ring having a weight of 6 pounds. The inner pad had an applied load of 3 pounds by a biasing means on the spindle. The substrate was rotated at a speed of 1000 rpm and the first pad was rotated at a speed of 5 rpm by rotation of the spindle. The second pad, when in contact with the substrate, rotated freely with the substrate. The substrate and the first pad were rotated in the opposite directions and the substrate surface was textured for 25 seconds.

The surface features of a textured substrate can be quantified by standard interferometry methods, in which the heights at many positions over the surface of the substrate is measured, and these coordinates are used to construct a three-dimensional topographic map of the surface. The interferometry measurements and calculations can be performed by commercially available interferometers, equipped with known microcomputer capability for calculating standardized average surface roughness, number of summits and maximum peak to valley distance, in a direction normal to the plane of the disc, over a given area, typically about $50\mu^2$. A summit is a peak that is at least a predetermined amount higher than the four nearest peaks. One interferometer which is suitable for this purpose is a Mirau Interferometer, Model Topo 3D, obtained from WYKO (Tucson, Ariz.).

Alternatively, the measurements may be taken with a contact profilometer. The profilometer consists of a stylus tip, typically diamond, which is dimensioned to follow the contour of the surface features of the disc. The stylus is slidably moved along a portion of the disc surface, usually over about a $1{,}000\mu$ interval, and the displacement of the stylus tip is recorded. One such device is available from Dektack.

Surface roughness is the arithmetic mean roughness value, calculated from the integral of the absolute value of peak or valley with respect to a center line, according to standard methods.

Figure 5:
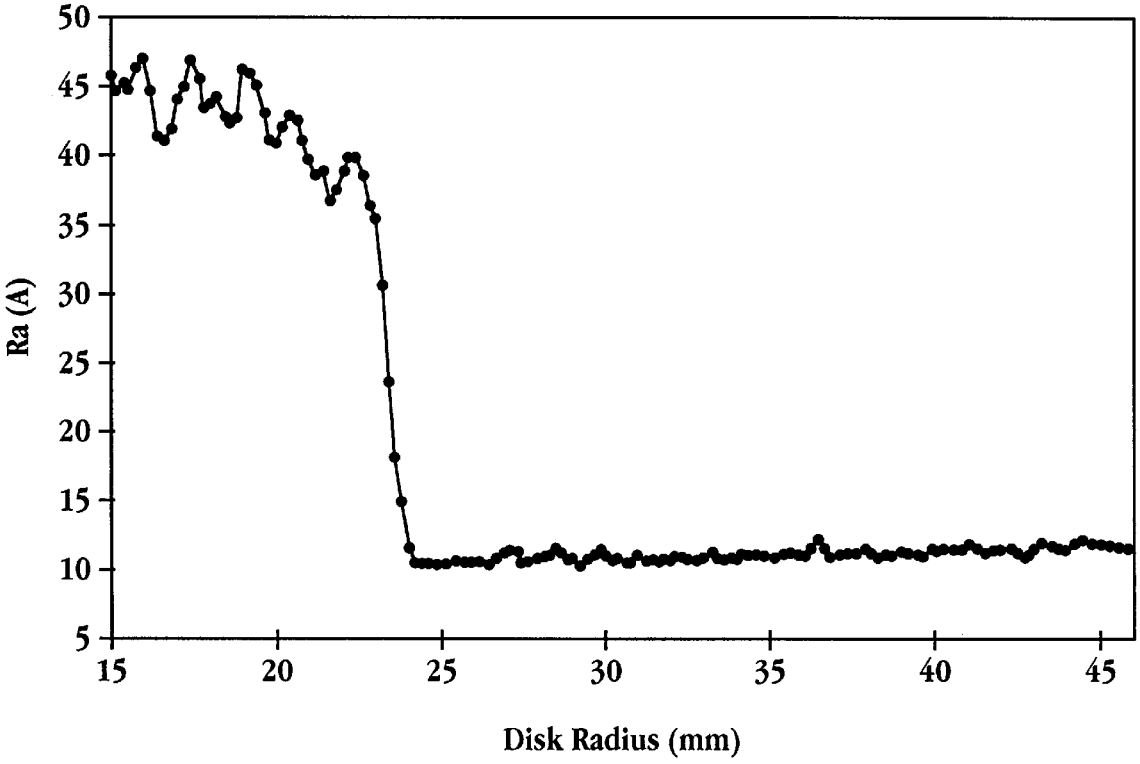
FIG. 5 shows disc roughness in Å as a function of disc radius in mm for a disc substrate textured according to the FIG. 4 embodiment of the invention.

FIG. 5 shows disc surface roughness in Å as a function of disc radius in mm for a disc substrate textured using the embodiment shown in FIG. 4, where the annular ring is engaged by the spindle for rotation of the first and second pads at the same speed. The substrate was textured for 25 seconds, after which surface roughness was determined. The figure shows that surface roughness in the landing zone or inner diameter region of the disc, e.g., at a disc radius of less than about 20 mm, is 4–5 times greater than the roughness of the disc surface in the outer, data zone, e.g., at a disc radius of greater than about 20 mm. The texture generated by the device of the invention provides a sharp transition between the two textured regions to maximize disc data zone area and provides a greater roughness in inner landing zone to minimize stiction with the read/write head.

In another experiment performed in support of the invention, a nickel/phosphorus plated aluminum substrate was textured using the embodiment of the texturing device shown in FIG. 3, where the rotational speed of the outer pad is controlled by a brake system. In this experiment, the first pad was composed of polyurethane impregnated with polyester-based material and the second pad was composed of polyester and polyamide fibers. As in the previous example, a load of 6 pounds was applied to the second pad and a load of 3 pounds was applied to the first pad. The substrate was rotated at a speed of 1000 rpm and the first pad was rotated at a speed of 5 rpm by rotation of the spindle. The second pad was rotated at a speed of 5 rpm. The substrate surface was textured for 25 seconds.

The surface features of the textured substrate were evaluated by determining surface-roughness, discussed above, and the average cross-hatch angle as a function of disc radius. The cross-hatch angle is taken as the angle a texture groove or particle trace makes with a second groove or trace crossing at the same point. Cross-hatch angle is measured by visualization of the textured surface under an optical microscope with 300× magnification at several radial positions.

Figure 6A:
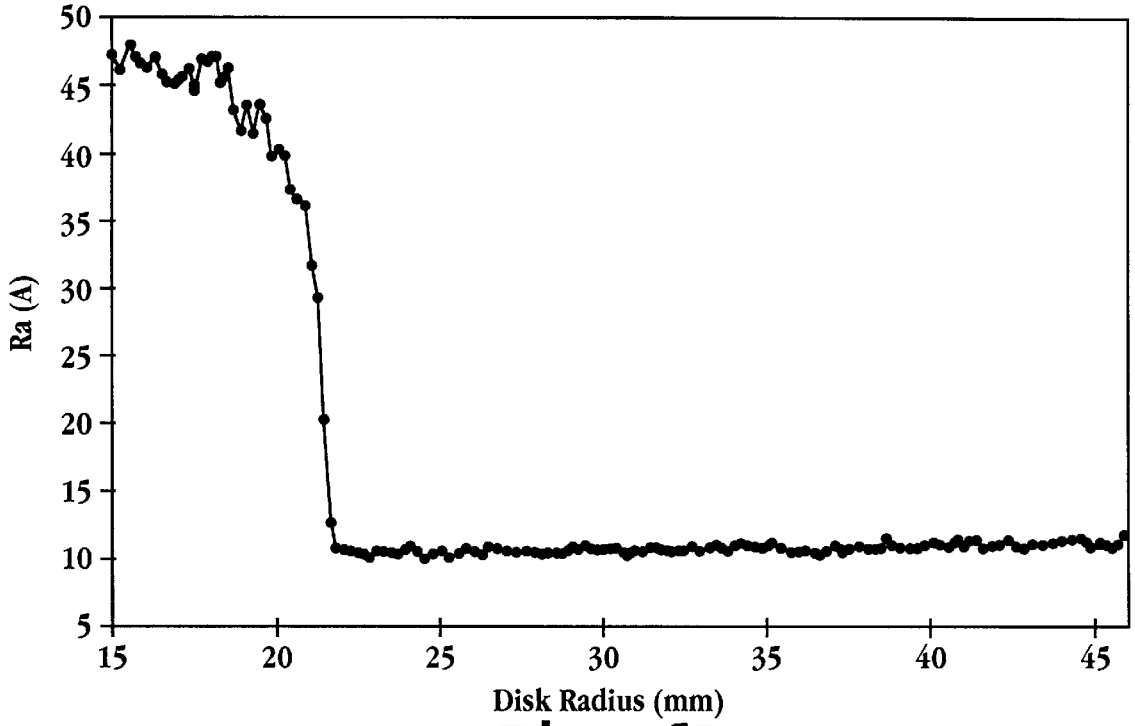
FIGS. 6A–6B show disc roughness in Å (FIG. 6A) and cross-hatch angle (FIG. 6B) as a function of disc radius in mm for a disc substrate textured according to the FIG. 3 embodiment of the invention.
Figure 6B:
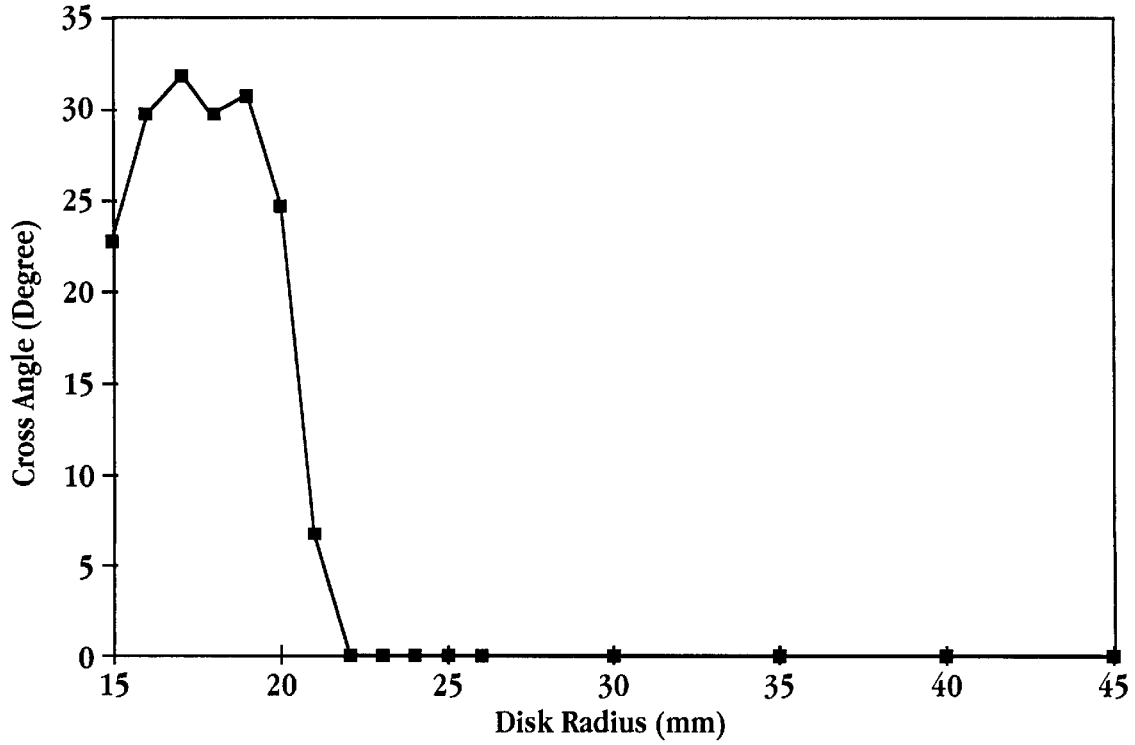

The results are shown in FIGS. 6A–6B, where FIG. 6A is a plot of roughness in Å and FIG. 6B is a plot of cross-hatch angle, both as a function of disc radius in mm. FIG. 6A shows that the surface roughness is 4–5 times greater in the inner diameter region of the disc than in the outer diameter region. FIG. 6B shows that the inner annular landing zone of the disc has a crosshatch angle of about 30° and, after an abrupt transition over about 2 mm, the cross-hatch angle falls to zero. That is, the circumferentially-textured outer annular data zone had no cross-hatching.

From the foregoing, it can be appreciated how various features and objects of the invention are met. The texturing device of the present invention provides for texturing the surface of a disc substrate with a dual-zone texture on the surface. That is, the inner, annular region of the disc is textured to have a greater roughness and cross-hatching than the outer, annular region of the disc. The differential texturing achievable with the device is provided by several of the device features, including the use of two pads which can rotate at the same speed or at different speeds. The load applied to each pad is easily varied, as is the speed and direction of rotation of each pad. The annular ring, which provides a dead-weight load to the second, outer pad, is simple in construction and easily interchangeable with rings of different weights. A texturing slurry is introduced between the two pads, for improved distribution between the inner and outer texturing surfaces.

Although the invention has been described with respect to particular embodiments, it will be apparent to those skilled in the art that various changes and modifications can be made without departing from the invention.

It is claimed:

1. A texturing device for texturing a disc substrate of the type used in forming a thin-film medium, comprising a rotatable assembly having (i) a spindle adapted for rotation about a spindle axis, and (ii) a first pad attached to one end of the spindle for rotation therewith, said first pad defining an inner texturing surface substantially normal to said axis, an annular ring having a second pad attached thereto, said ring mounted on said rotatable assembly for movement thereon toward and away from said first pad, substantially in the direction of said axis, said second pad defining an outer annular texturing surface which encompasses said inner texturing surface, when said ring is fully moved toward said first pad, wherein the outer texturing surface presses against a disc substrate surface with a force that depends on the weight of the ring, when the rotatable assembly is positioned with its inner texturing surface placed against said disc substrate surface.

2. The device of claim 1, wherein said ring, when fully moved toward said first pad, mounts on the rotatable assembly for rotation thereon, independent of rotation of said first pad.

3. The device of claim 2, which further includes a brake mounted adjacent said ring so that said brake contacts said ring to control rotation of said ring.

4. The device of claim 1, wherein said ring, when fully moved toward said first pad, mounts on the rotatable assembly for rotation therewith.

5. The device of claim 4, wherein said ring includes a central opening and said spindle engages the central opening.

6. The device of claim 4, wherein said ring has a confronting surface facing said first pad, and wherein said first pad engages said confronting surface of said ring, securing said ring to said first pad.

7. The device of claim 2, wherein said spindle and an inner edge of said ring and an inner edge of said first pad define a gap for introducing a texturing slurry between the two texturing surfaces.

8. The device of claim 7, wherein said slurry contains abrasive particles having a size between 0.05–20 microns.

9. The device of claim 1 which further includes means for biasing the inner texturing surface against the disc substrate, with a load of between 1–30 pounds.

10. The device of claim 1, wherein said ring has a weight of between about 1–30 pounds.

11. The device of claim 1, wherein said outer annular texturing surface has an area of between 10–100 $cm^2$.

12. The device of claim 1, wherein said first pad and said second pad are coaxial.

13. The device of claim 1, wherein said first pad and said second pad are made of identical materials.

14. The device of claim 1, wherein said first pad and said second pad are made of different materials.

15. The device of claim 1, wherein said spindle rotates with a speed of between 1–2000 RPM.

16. The device of claim 1, wherein said ring rotates at a speed of between 1–2000 RPM.

17. A texturing device for texturing a disc substrate of the type used in forming a thin-film medium, comprising a rotatable assembly having (i) a spindle adapted for rotation about a spindle axis, and (ii) a first pad attached to) one end of the spindle for rotation therewith, said first pad defining an inner texturing surface substantially normal to said axis, an annular ring having a second pad attached thereto, said ring mounted on said rotatable assembly for movement along said spindle toward and away from said first pad, substantially in the direction of said axis, said second pad defining an outer annular texturing surface which encompasses said inner texturing surface, when said ring is fully moved toward said first pad, said outer texturing surface defining a plane which intersects said spindle during movement of said ring along said spindle toward and away from said first pad.

18. A texturing device for texturing a disc substrate of the type used in forming a thin-film medium, comprising a rotatable assembly having (i) a spindle adapted for rotation about a spindle axis, and (ii) a first pad attached to one end of the spindle for rotation therewith, said first pad defining an inner texturing surface substantially normal to said axis, an annular ring having a second pad attached thereto, said ring mounted on said rotatable assembly for movement thereon toward and away from said first pad, substantially in the direction of said axis, said second pad defining an outer annular texturing surface which encompasses said inner texturing surface, when said ring is fully moved toward said first pad, a first load applicable to said first pad via said spindle, said first load contributing to a first biasing force which presses said first texturing surface against said disc substrate, a second load, independent of said first load, applicable to said second pad, said second load contributing to a second biasing force which presses said second texturing surface against said disc substrate, wherein increasing said first load causes said first biasing force to increase without causing said second biasing force to increase.

19. A texturing device for texturing a disc substrate of the type used in forming a thin-film medium, comprising a rotatable assembly having (i) a spindle adapted for rotation about a spindle axis, and (ii) a first pad attached to one end of the spindle for rotation therewith, said first pad defining an inner texturing surface substantially normal to said axis, an annular ring having a second pad attached thereto, said ring mounted on said rotatable assembly for movement thereon toward and away from said first pad, substantially in the direction of said axis, said second pad defining an outer annular texturing surface which encompasses said inner texturing surface, when said ring is fully moved toward said first pad, said first texturing surface being substantially coplanar with said second texturing surface when said ring is fully moved toward said first pad so that, upon moving said rotatable assembly towards said disc substrate, said inner and outer texturing surfaces contact said disc substrate at approximately the same time.

20. The device of claim 1, wherein the weight of the ring is the predominant force acting to press the outer texturing surface against the disc substrate surface, when the rotatable assembly is positioned with its inner texturing surface placed against the disc substrate surface.

* * * * *